US011466455B2

(12) United States Patent
Gajare

(10) Patent No.: US 11,466,455 B2
(45) Date of Patent: Oct. 11, 2022

(54) BUILDING BLOCK

(71) Applicant: Sachin Shripad Gajare, Pune (IN)

(72) Inventor: Sachin Shripad Gajare, Pune (IN)

( * ) Notice: Subject to any disclaimer, the term of this patent is extended or adjusted under 35 U.S.C. 154(b) by 457 days.

(21) Appl. No.: 16/330,088

(22) PCT Filed: Sep. 6, 2017

(86) PCT No.: PCT/IN2017/050384
§ 371 (c)(1),
(2) Date: Mar. 3, 2019

(87) PCT Pub. No.: WO2018/047199
PCT Pub. Date: Mar. 15, 2018

(65) Prior Publication Data

US 2021/0285213 A1 Sep. 16, 2021

(30) Foreign Application Priority Data

Sep. 8, 2016 (IN) ..... 201621030753

(51) Int. Cl.
*E04C 1/39* (2006.01)

(52) U.S. Cl.
CPC ..... *E04C 1/392* (2013.01); *E04C 1/397* (2013.01)

(58) Field of Classification Search
CPC ..... E04C 1/392; E04C 1/397; E04C 1/39
See application file for complete search history.

(56) References Cited

U.S. PATENT DOCUMENTS 761,711 A * 6/1904 Redfern ..... E04C 1/392 52/302.4
869,770 A * 10/1907 Birnstock ..... E04B 2/28 52/444
1,203,934 A * 11/1916 Straight ..... E04C 1/392 52/302.4
1,668,348 A * 5/1928 Anderson ..... E04C 1/392 52/375
1,785,499 A * 12/1930 Sayers ..... E04B 2/48 52/505
1,836,408 A * 12/1931 Sutton ..... E04C 1/397 285/119

(Continued)

FOREIGN PATENT DOCUMENTS

DE 102009032203 A1 * 1/2011 ..... F24D 13/024
DE 102012205034 A1 8/2015

(Continued)

*Primary Examiner* — James M Ference

(57) ABSTRACT

The present invention provides a building block for constructing a passage in a building for passing water pipe line, electric cables, gas pipelines, internet cable, set top box cables, and the like. The building block is having at least one channel extending across a body of the building block. The building block further has a lid for closing and opening the channel. According to the present invention, a plurality of building blocks when arranged in predefined sequence in at least a wall, roof and flooring of the building, pathways, it creates the passage for circulating wiring or pipelines therethrough and the lid can be open for maintenance purpose thereby preventing structural damage to the building. The building block has an advantage of inbuilt channel with removable lid, which reduces the time in cutting and drilling in the wall.

14 Claims, 21 Drawing Sheets

(56) References Cited

U.S. PATENT DOCUMENTS 1,863,543 A * 6/1932 Palmer ..... E04C 1/397 52/561
2,703,487 A * 3/1955 Ossoinack ..... E04B 2/30 52/592.3
3,391,507 A * 7/1968 Downing ..... E04C 1/397 52/314
4,002,002 A * 1/1977 Barnhardt, Jr. ..... B28B 11/043 264/269
4,051,640 A * 10/1977 Vincens ..... E04C 3/07 174/101
4,573,301 A * 3/1986 Wilkinson ..... E04B 2/18 52/220.2
5,063,723 A * 11/1991 Yoder ..... E04C 1/39 52/561
5,546,721 A * 8/1996 Daniells ..... E04C 1/39 52/606
5,822,939 A * 10/1998 Haener ..... E04C 1/41 52/404.1
5,852,906 A * 12/1998 Kuban ..... E04B 1/7023 52/302.1
5,901,520 A * 5/1999 Abdul-Baki ..... E04B 2/16 52/592.6
6,691,485 B1 * 2/2004 Prokofyev ..... E04B 2/26 52/607
8,820,024 B1 * 9/2014 Abdullah ..... E04B 2/08 52/605
8,887,466 B2 * 11/2014 Alvarez Moysen ..... E04B 2/52 52/590.3
9,074,362 B1 * 7/2015 Munz ..... E04C 1/397
9,309,667 B2 * 4/2016 Thompson ..... E04C 1/397
9,404,255 B1 * 8/2016 Castro ..... E04B 2/46
9,938,713 B1 * 4/2018 Ertl ..... E04B 2/50
2002/0043038 A1 * 4/2002 Cerrato ..... E04C 5/08 52/604
2005/0108972 A1 * 5/2005 Banova ..... E04B 2/54 52/596
2008/0047219 A1 * 2/2008 Donohew ..... E04C 1/397 52/603
2008/0184650 A1 * 8/2008 Fischer ..... E04B 2/8629 52/606
2008/0307745 A1 * 12/2008 Lemieux ..... E04C 1/395 52/745.1
2010/0018150 A1 * 1/2010 Azar ..... E04B 2/46 52/606
2010/0212241 A1 * 8/2010 Holroyd ..... E04C 2/36 52/309.4
2010/0236179 A1 * 9/2010 Kim ..... E04B 2/42 52/578
2014/0007529 A1 * 1/2014 Alvarez Moysen ..... E04B 2/52 52/220.2
2015/0059278 A1 * 3/2015 Rainio ..... E04C 1/395 52/431
2015/0075106 A1 * 3/2015 Vandenbempt ..... E04B 2/18 52/596
2015/0308128 A1 * 10/2015 Mullaney ..... H02G 3/288 52/126.3
2016/0108614 A1 * 4/2016 Munz ..... E04B 2/02 52/604
2016/0145864 A1 * 5/2016 Al-Salloum ..... E04B 2/18 52/600
2016/0281357 A1 * 9/2016 Aribas ..... E04B 2/18
2017/0260743 A1 * 9/2017 Simonson ..... E04B 2/40
2018/0044914 A1 * 2/2018 Martinez ..... E04B 2/08
2021/0285213 A1 * 9/2021 Gajare ..... E04C 1/397

FOREIGN PATENT DOCUMENTS

GB 587042 A * 4/1947 ..... E04C 1/397
GB 2358883 A * 8/2001 ..... E04C 1/397

* cited by examiner

BUILDING BLOCK

FIELD OF THE INVENTION

The present invention relates to a construction. More particularly, the present invention relates to a building block for constructing a passage in a building for passing cables, pipes and the like.

BACKGROUND OF THE INVENTION

Generally, it is seen at many construction sites that channels are carved passing electrical wires, pipes or conduit by machine or manually which is time consuming and lot of labour is required. The channel generally is carved on wall, ceiling and floor of the house of the building and digging in pathways. Once, the finishing of the construction site is done and the channels are closed, thereafter it is very difficult to add any new cables, pipes and conduits wiring and carry out maintenance activity in case of any damages to the cables including electrical wires, internet cables, set top cables and the pipes including gas pipelines, water pipes or conduits. During maintenance, the wall, floor or pathways is drilled or dig again to open the channel to find out the damage, which creates lot of vibrations in the wall and may even lead to cracks in the wall floor or pathways. These vibrations may loosen the bond between the bricks of the wall. Also, refitting of the electrical wiring, pipes or conduit, in conventional type bricks is time consuming.

Till now, there is no such method or a system which can overcome the drawbacks of the present way of repairing or refitting of electrical wiring, pipes or conduit after construction of concealed walls.

Therefore, there is a need of a system which can overcome at least one of the drawbacks as discussed above.

SUMMARY OF THE INVENTION

An object of the present invention is to provide a building block for constructing a passage in a building for passing cables and pipes wherein pipes include water pipe line, sewage pipeline, gas pipelines and the like and cables includes electric cables internet cable, set top box cables, and the like.

Accordingly, the present invention in an aspect provides a building block for constructing a passage in a building for passing cables and pipes including water pipe line, sewage pipeline, electric cables, gas pipelines, internet cable, set top box cables, and the like. The building block is having an at least one channel extending across a body of the building block and a lid for closing and opening the channel, said lid covers removably one or more channels. According to the present invention, a plurality of building blocks are arranged in predefined sequence in at least a wall, roof and flooring of the building to create the passage for circulating wiring or pipelines therethrough and the lid can be open for maintenance purpose thereby preventing structural damage to the building. Accordingly, the building block provides inbuilt passage with removable lid, which reduces the time in cutting and drilling in the wall.

According to the present invention, the body is having two cavities extending length wise and the lid has two projections extending length wise to fit in the two cavities of the body for securing the lid over the body for covering the channel. According to an embodiment, each of the cavities may have a tapered portion or holes for engaging with a locking protrusion of the projection of the lid therein for locking the lid with the body. The projections of the lid may have cross-opening at middle for passing of cross pipes in the lid. The body may have a connecting projection and a groove configured on the opposite surface for aligning with an adjacent block.

According to an embodiment of the present invention, the lid locks against the body by a press-fit or snap-fit locking arrangement or by bolts. According to the present invention, the lid may have two projections extending toward the body and away from the body, the projections extending away from the body are used for securing a file or any decorative display therein. Further, the lid may have a locator for locating the passage of the wiring or piping formed the channels of the building block. Moreover, the lid may have at least one extension for covering L-shaped, T-shaped channels. In an alternative embodiment, the lid may comprise a plate arranged on the surface for preventing drilling therethrough.

According to an embodiment of the present invention, the lid may have at least one raised corner or a hook for engaging a tool for disengaging the lid from the body. Further, the lid may have an extension, with an opening, the opening can be accessed for draining purpose or for other maintenance activity, the extension engages with a groove configured on the body, an elbow with a cover is arranged in an elbow opening before placing the lid thereover, the lid can be separated to removing the elbow for maintenance purpose.

According to an embodiment of the invention, the at least one channel is straight, circular shape, "T" shape. "L" shaped, "+" shaped etc. The lid is also "T" shaped, "L" shaped, revered "L" shaped "+" shaped etc to cover one or more channels removably.

In the present embodiment, body and/or lid is made of material including cement, plastic, clay, Plaster of Paris, FRP.

According to an embodiment of the invention, an inner surface of the channel in body and channel covering surface of lid is having coating of an insulating material. According to the present invention, the channel is having a rectangular or circular configure a junction box therein. The channel may comprise a through-opening for entry or exit of pipeline and/or cable.

According to an embodiment of the invention, the building block may comprise an insert secured over the channel and below the lid.

According to an embodiment of the present invention, the body may have two or more channels, which are extended parallel. Moreover, the body having two channels, which may be non-parallel.

In another aspect, the present invention provides a building block for constructing a passage in a building for pipes including water pipe line, sewage pipeline, and the like, the building block comprising a lid with an extension and an opening, the opening can be accessed for draining purpose or for other maintenance activity and a body having have a groove and a elbow opening. The extension engages with the groove configured on the body, the elbow with a cover is arranged in the opening before placing the lid thereover, the lid can be separated to separate the elbow for maintenance purpose.

The building block of present invention reduces time required for cutting and drilling in the wall for maintenance purpose as they formed passage of required size. Further, the building block of the present invention forms passage of required size along with removable covering at the time of building of wall or pathways, maintenance of water pipe line, electric cables, gas pipelines, internet cable, set top box cables, and the like can be carried out without damaging the wall. As, the building block of the present invention forms passage of required size along with removable covering at the time of building of wall, it reduces the destruction of the building, thereby protecting the environment from debris and dust. The building blocks of the present invention are simple and economical in operation.

BRIEF DESCRIPTION OF DRAWINGS

The organization and manner of operation of the invention, together with the further objects and advantages thereof, may best be understood by reference to the following description taken in connection with the accompanying drawings in which like reference numerals identify like elements and in which.

DETAILED DESCRIPTION OF THE INVENTION

Figure 1A:
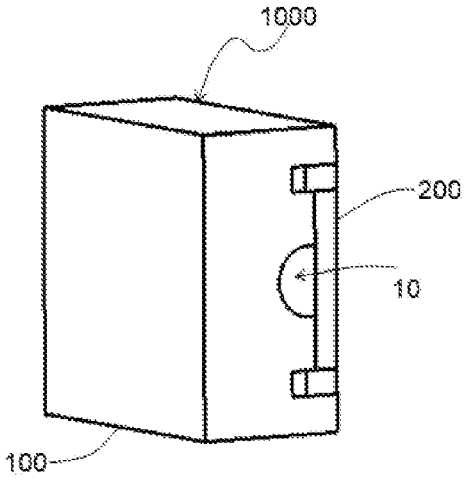
FIG. 1*a* shows a perspective of a building block in accordance with the present invention.

An embodiment of this invention, illustrating its features, will now be described in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The terms "a" and "an" herein do not denote a limitation of quantity, but rather denote the presence of at least one of the referenced item.

In general, the present invention provides a building block for constructing a passage in a building for passing cables and pipes including water pipe line, sewage pipeline, electric cables, gas pipelines, internet cable, set top box cables, and the like. The building block is having an at least one channel extending across a body of the building block and a lid for closing and opening the channel, said lid covers removably one or more channels. According to the present invention, a plurality of building blocks are arranged in predefined sequence in at least a wall, roof and flooring of the building to create the passage for circulating wiring or pipelines therethrough, the lid can be open for maintenance purpose thereby preventing structural damage to the building.

According to the present invention, the body is having two cavities extending length wise and the lid has two projections extending length wise to fit in the two cavities of the body for securing the lid over the body for covering the channel. According to an embodiment, each of the cavities may have a tapered portion or holes for engaging with a locking protrusion of the projection of the lid therein for locking the lid with the body. The projections of the lid may have cross-opening at middle for passing of cross pipes in the lid. The body may have a connecting projection and a groove configured on the opposite surface for aligning with an adjacent block.

According to the present invention, the lid locks against the body by a press-fit or snap-fit locking arrangement or by bolts. According to the present invention, the lid may have two projections extending toward the body and away from the body, the projections extending away from the body are used for securing a tile or any decorative display therein. Further, the lid may have a locator for locating the passage of the wiring or piping formed the channels of the building block. Moreover, the lid may have at least one extension for covering L-shaped, T-shaped channels. In an alternative embodiment, the lid may comprise a plate arranged on the surface for preventing drilling therethrough.

According to an embodiment of the present invention, the lid may have at least one raised corner or a hook for engaging a tool for disengaging the lid from the body. Further, the lid may have an extension, with an opening, the opening can be accessed for draining purpose or for other maintenance activity, the extension engages with a groove configured on the body, an elbow with a cover is arranged in an elbow opening before placing the lid thereover, the lid can be separated to removing the elbow for maintenance purpose.

According to an embodiment of the invention, the at least one channel is straight, circular shape, "T" shape, "L" shaped. "+" shaped etc. The lid is also "T" shaped, "L" shaped, revered "L" shaped "+" shaped etc to cover one or more channels removably.

In the present embodiment, body and/or lid is made of material including cement, plastic, clay, Plaster of Paris, FRP.

According to an embodiment of the invention, an inner surface of the channel in body and channel covering surface of lid is having coating of an insulating material. According to the present invention, the channel is having a rectangular or circular configure a junction box therein. The channel may comprise a through-opening for entry or exit of pipeline and/or cable.

According to an embodiment of the invention, the building block may comprise an insert secured over the channel and below the lid.

According to an embodiment of the present invention, the body may have two or more channels, which are extended parallel. Moreover, the body having two channels, which may be non-parallel.

The present invention also provides a building block for constructing a passage in a building for pipes including water pipe line, sewage pipeline, and the like, the building block comprising a lid with an extension and an opening, the opening can be accessed for draining purpose or for other maintenance activity and a body having have a groove and a elbow opening. The extension engages with the groove configured on the body, the elbow with a cover is arranged in the opening before placing the lid thereover, the lid can be separated to separate the elbow for maintenance purpose.

The present invention provides a building block for constructing a passage in a building for passing water pipe line, electric cables, gas pipelines, internet cable, set top box cables, and the like. The building block building block reduces the time in cutting and drilling in the wall for maintenance purpose. Also, the building block does not damage the wall for maintenance of water pipe line, electric cables, gas pipelines Internet cable, set top box cables, and the like. Further, the building block reduces the destruction of the old building, thereby protecting the environment from debris and dust. Furthermore, the building block is simple and economical. Moreover, the building block is robust in operation.

Referring now to FIG. 1*a*, a building block 1000 for constructing a passage in a building for passing water pipe line, electric cables, gas pipelines, internet cable, set top box cables, and the like in accordance with the present invention is illustrated. The building block 1000 includes a body 100, at least one channel 10 and a lid 200 for closing and opening the channel 10.

Figure 1B:
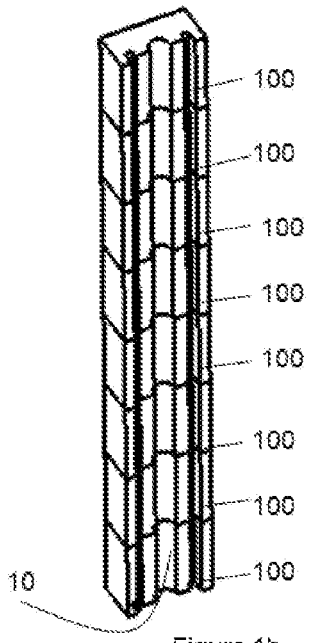
FIG. 1*b* shows a series of building blocks arranged in a straight line in accordance with the present invention.

In the present embodiment, the building block 1000 includes a body 100 on which one channel 10 is extended across a body 100 of the building block 1000. The channel 10 is straight (refer FIG. 1*b*), "O" shape, "T" shaped, "L" shaped, "+" shaped and the like. A plurality of building blocks 1000 are arranged in predefined sequence in at least a wall, roof and or flooring of the building to create the passage for circulating wiring or pipelines therethrough as shown in FIG. 1*b*. In the present embodiment, the body 100 cam be "T" shaped, "L" shaped, revered "L" shaped "+" shaped and the like. Further, the present invention includes the lid 200. The lid 200 is used for closing and opening the channel 10. Also, the lid 200 can be opened for maintenance purpose thereby preventing structural damage to the building. The lid 200 and the body 1000 is made of cement, plastic, clay, plaster of paris, FRP or any other material which is flexible as well as rigid enough to protect the connections passing through the channel 10. Also, the body 100 has plurality of channels, which is extending parallely to each other (not shown). In an alternate embodiment, the body 100 has plurality of channels, which is not parallel to each other (not shown).

Figure 2A:
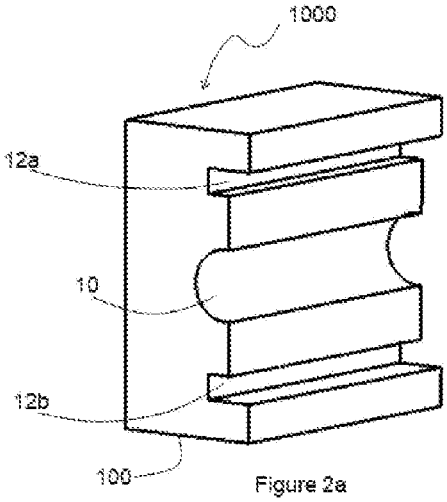
FIG. 2*a* shows a perspective view of a body of the building block in accordance with the present invention.
Figure 2B:
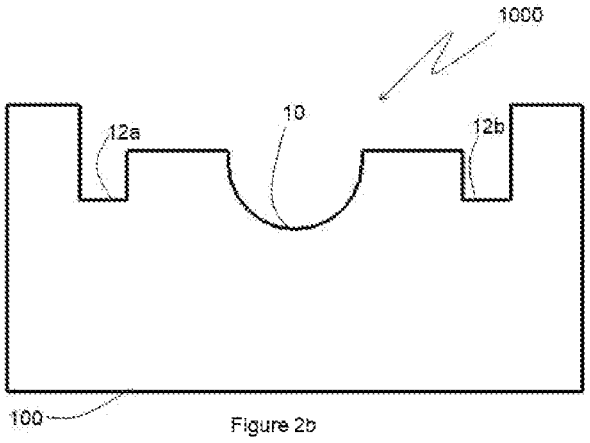
FIG. 2*b* shows a front view of FIG. 2*a;*

FIG. 2*a* shows a perspective view of the body 100. The body 100 is having one channel 10 for fixing the electrical cables, gas pipelines, water conduits, internet cable, set top box cables and the like. As the body 100 has a channel 10, this reduces the time in cutting and drilling in the wall for creating channels therein. The body 100 and the lid 200 can also be easily be integrated with the existing wall or can be arranged in a defined pattern while constructing new building for creating channels for passing the electrical cables, gas pipelines, water conduits, internet cable, set top cables and the like. Also, the body 100 have cavities 12*a* and 12*b* which is extended length wise. The cavities 12*a* and 12*b* are configured for securing the lid 200 over the body 100. A sectional view of the body 100 is shown in FIG. 2*b*.

Figure 3A:
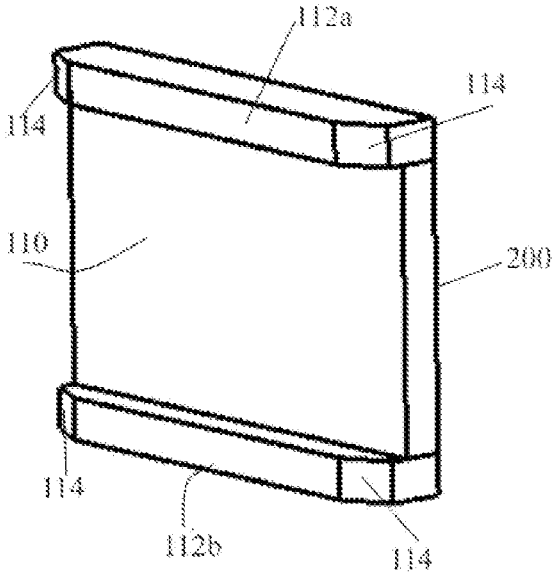
FIG. 3*a* shows perspective view of a lid of the building block in accordance with the present invention.
Figure 3B:
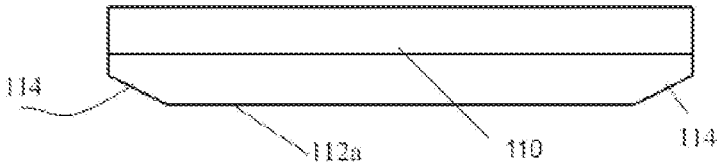
FIG. 3*b* shows aside view of a lid in accordance with the present invention.
Figure 4:
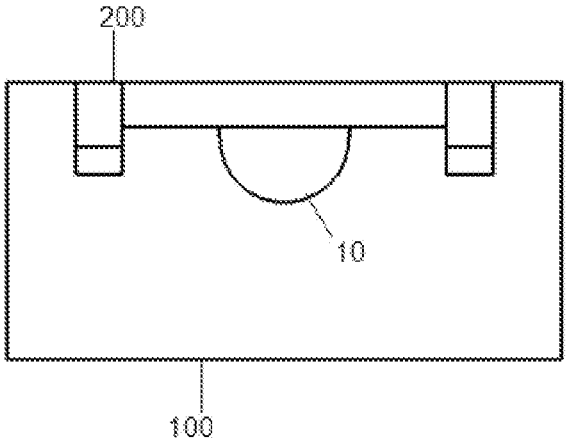
FIG. 4 shows a sectional view of the building block in accordance with the present invention.
Figure 5C:
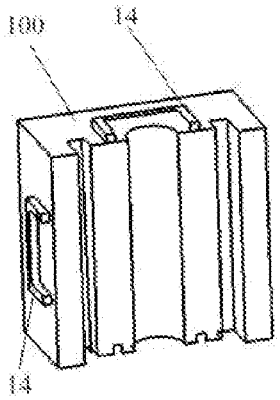
FIGS. 5*a*, 5*b* and 5*c* show the body with projection and grooves configured on the body in accordance with the present invention.
Figure 5A:
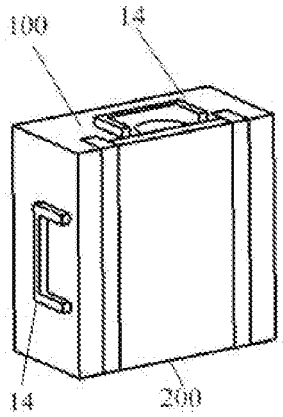
Figure 5B:
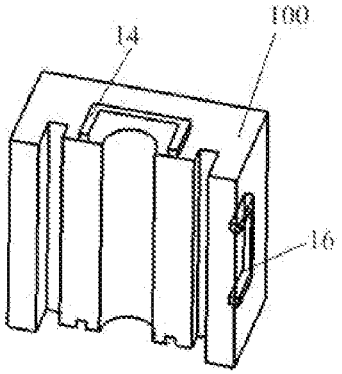

Referring now to FIGS. 3*a*, 3*b* and 4, perspective views of the lid 200 is shown. The lid 200 can be removably secured to the body 100 for closing the opening the channel 10 of the body 100. The lid 200 can be open for maintenance purpose of electrical cables, gas pipelines, water conduits, internet cable, set top cables, and thereby preventing damage to the building caused due to hammering and vibrations caused by drilling in the wall. The lid 200 has the inner surface 110 facing towards the body. The lid 200 has two projections 112*a* and 112*b* which are extended length wise on the lid 200. Also, the lid 200 has at least one raised corner 114, which create a gap for engaging and disengaging the lid 200 from the body 100. Wherein the raised corner 114 can be tapered corner or a blunt corner or any other shape. A tool like screw driver can be inserted in gap between the cavity 12*a* or 12*b* and the tapered corner 114 for disengaging the lid 200 from the body 100. The side view of the lid 200 is shown in FIG. 3*b* and FIG. 4 shows a sectional view of the building block 1000.

Figure 6:
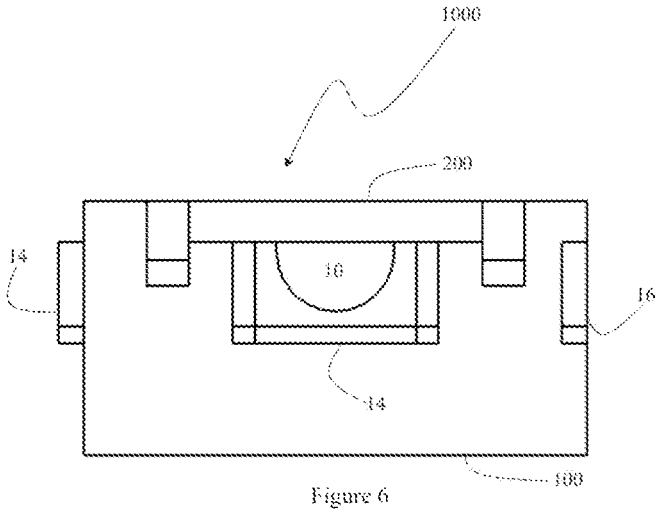
FIG. 6 shows a sectional view of the body FIGS. 5*a*, 5*b* and 5*c;*

Referring to FIGS. 5*a*, 5*b*, 5*c* and 6, an embodiment of the body 100 with connecting projections 14 and grooves is shown. Specifically, the connecting projection 14 and the groove 16 are configured on the opposite surface of the body 100. The connecting projection 14 of the body 100 can be connected with the groove 16 of another body 100 for creating a channel (as shown in FIG. 1*b*) with proper alignment. Referring to FIG. 6, a sectional view of the body 100 with projection 14 and the groove 16 is shown.

Figure 7A:
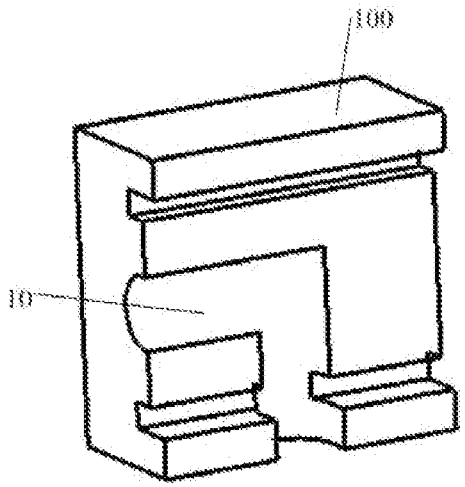
FIGS. 7*a* and 7*b* show perspective views of the body having L-shaped channel in accordance with the present invention.
Figure 7B:
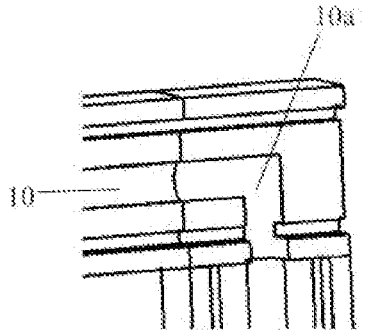

FIGS. 7*a* and 7*b* shows an L-shaped channel 10*a* configured in the body 100. The L-shaped channel 10*a* is connected with the existing body 100 for aligning the L-shaped channel 10*a* with the at least channel 10 of the body 100 as shown in FIG. 7*b*.

Figure 8:
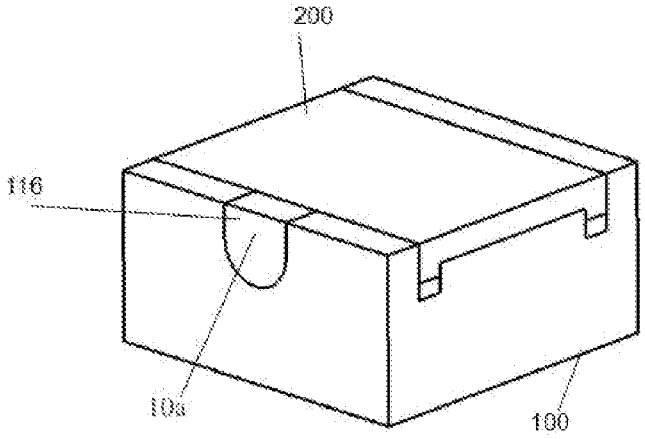
FIG. 8 shows a perspective view of the building block with the body and the lid having a L-shaped in accordance with the present invention.

Referring to FIG. 8, the building block 1000 of the body 100 with L-shaped channel 10*a* and the lid 200 is shown. The lid 200 is having an extension 116 for covering an extended portion of the L-shaped channel 10*a*.

Figure 9A:
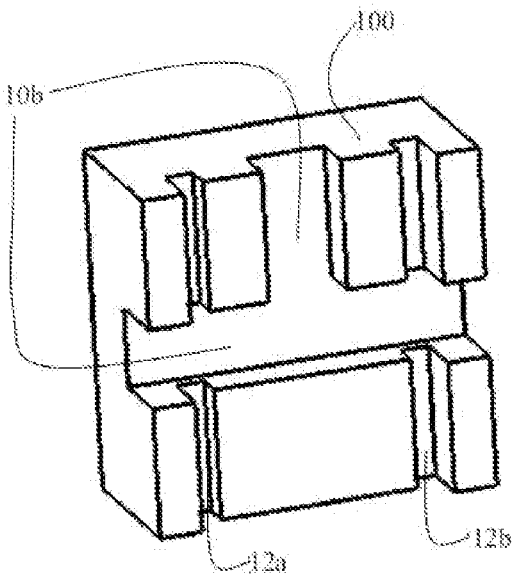
FIGS. 9*a* and 9*b* shows perspective views of a body having T-shaped channel in accordance with the present invention.
Figure 9B:
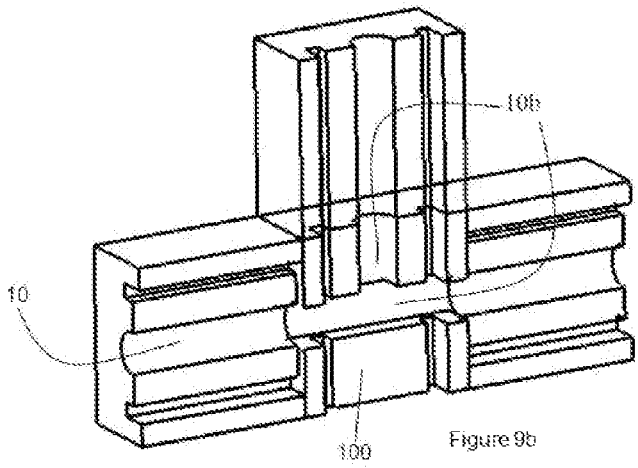

FIG. 9*a* shows a T-shaped channel 10*b* configured in the body 100. The T-shaped channel 10*b* is connected with the existing body 100 for aligning the T-shaped channel 10*b* with the at least channel 10 of the body 100 as shown in FIG. 9*b*.

Figure 10:
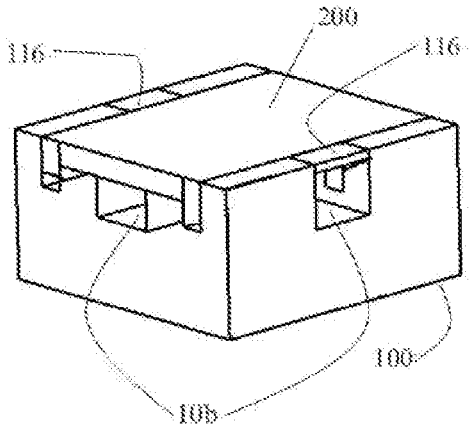
FIG. 10 shows a perspective view of FIGS. 9*a* and 9*b* along with the lid.

Referring to FIG. 10, the building block 1000 of the body 100 with T-shaped channel 10*b* and the lid 200 is shown. The lid 200 is having extensions 116 for covering an extended portion of the T-shaped channel 10*b*.

Figure 11A:
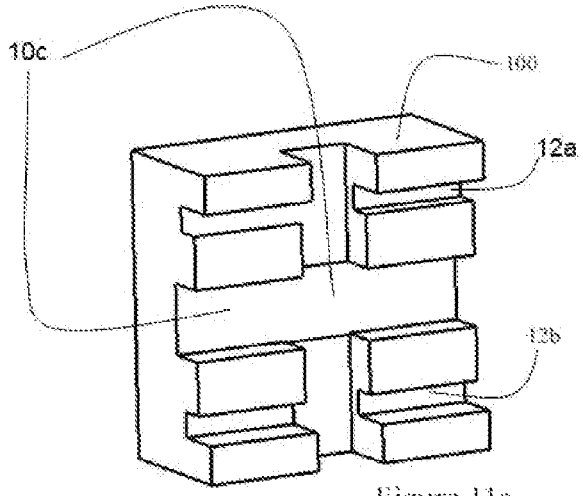
FIGS. 11*a* and 11*b* show perspective views of a body with cross (+) shaped channel in accordance with the present invention.
Figure 11B:
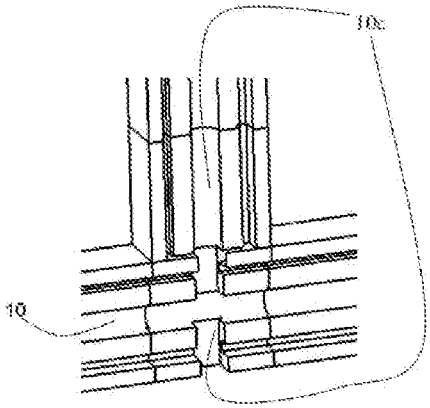

Referring to FIG. 11*a*, a cross "+" shaped channel 10*c* is configured in the body 100. The cross "+" shaped, channel 10*c* is connected with the existing body 100 for aligning the cross "+" shaped channel 10*c* with the at least channel 10 of the body 100 as shown in FIG. 11*b*.

Figure 12A:
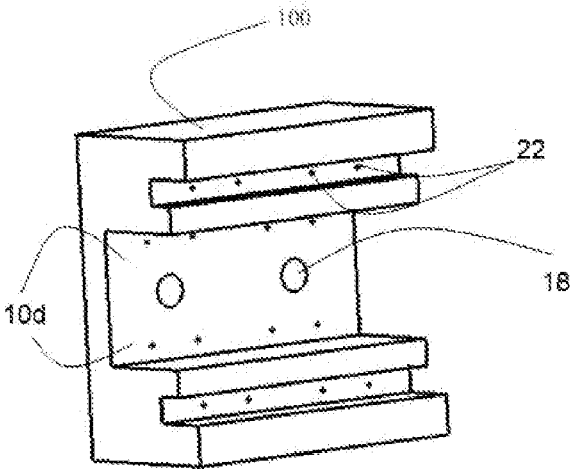
FIG. 12*a* shows a perspective view of a body having a water mixer opening (or any multiple pipeline laying), in accordance with the present invention.
Figure 12B:
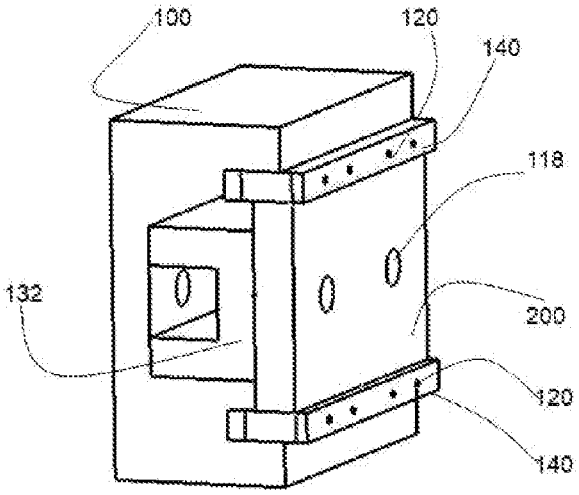
FIG. 12*b* shows a perspective view of the building block of FIG. 12*a* with a insert and a lid with outward projections.
Figure 13:
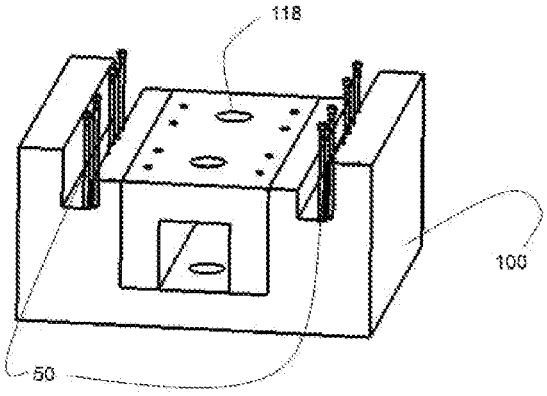
FIG. 13 shows a perspective view of the body with a water mixer opening, a guiding rod, and a detachable middle insert in accordance with, the present invention.

Referring to FIG. 12*a*, two openings 18 are configured on the body 100, which are used for laying separate pipeline for water mixer of hot and cold water/or any other multiple pipe laying. An insert 132 is provided in the body 100. Further, the lid 200 has two openings 118 for arranging the lid 200 on the top of the body 100 by aligning the openings 118 of the lid 200 and 18 of the body 100. The lid 200 is extended for covering the channel 10 which has the openings 118 and a plurality of apertures 120 as shown in FIG. 12*b*. Similarly, the body 100 has plurality of apertures 10*d* configured thereon. Further, the lid 200 is having two projections 140 of extending towards the body 100 and away from the body 100. The projection 140 which is extending away from the body 100 is used for securing decorative tiles. Referring to FIG. 13, a guiding rod 50 is passed through the apertures 120 on the body 100 and the aperture 10*d* of the lid 200 for maintaining alignment therebetween. The lid 200 locks against the body 100 by a press-fit or snap-fit locking arrangement or by bolts.

Figure 14A:
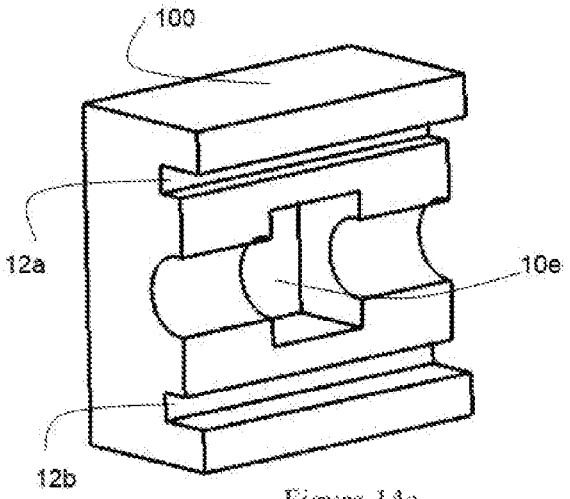
FIGS. 14*a* and 14*b* shows perspective views of the box body with a rectangular junction in accordance with the present invention.
Figure 14B:
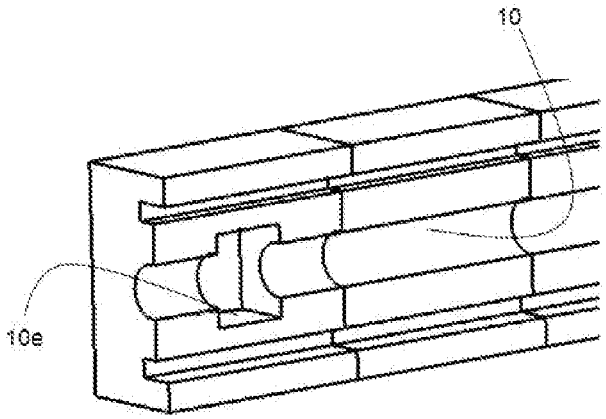

Referring to FIG. 14*a*, a rectangular junction 10*e* is configured in the body 100. The rectangular junction 10*e* is connected with the body 100 for aligning the rectangular junction 10*e* at least channel 10 of the body 100 as shown in 14*b*. The rectangular junction 10*e* is used to configure a junction box therein.

Figure 15A:
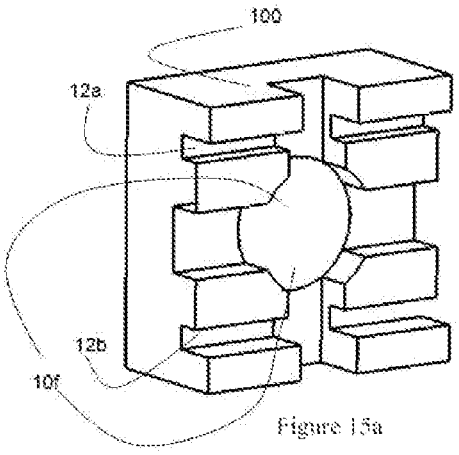
FIGS. 15*a* and 15*b* perspective views of the box body with a circular junction in accordance with the present invention.
Figure 15B:
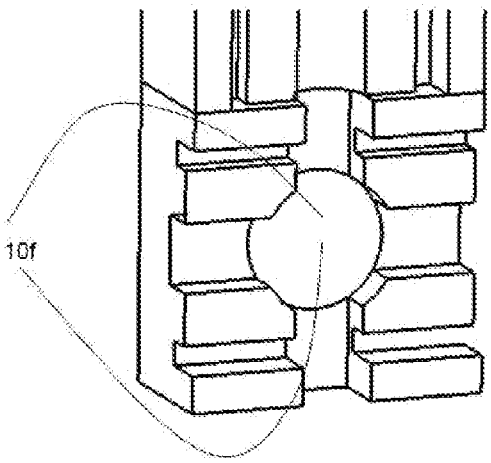
Figure 16:
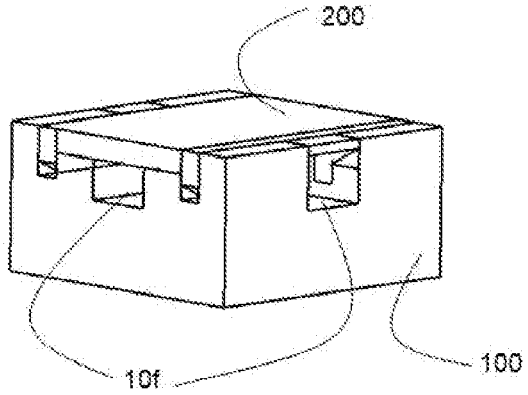
FIG. 16 shows a perspective view of a building block with a junction in accordance with the present invention.

Referring to FIG. 15*a*, a circular shaped channel 10*f* is configured in the body 100. The circular junction 10*f* is connected with the existing body 100 for aligning the circular junction 10*f* with the at least channel 10 of the body 100 as shown in FIG. 15*b*. In FIG. 16, the lid 200 is used for covering the circular junction 10*f* which is configured in the body 100.

Figure 17A:
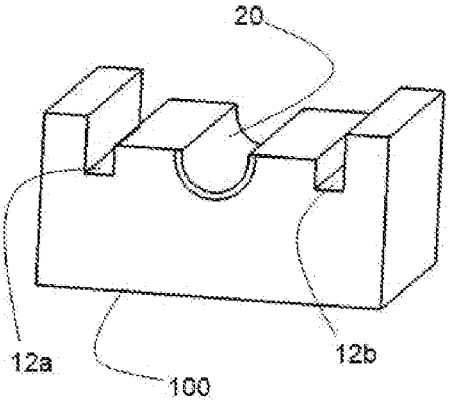
FIGS. 17*a* and 17*b* shows perspective views of the body with in accordance with the present invention.
Figure 17B:
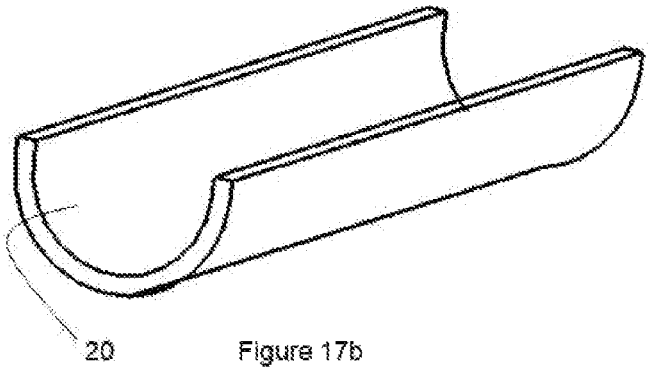
Figure 18:
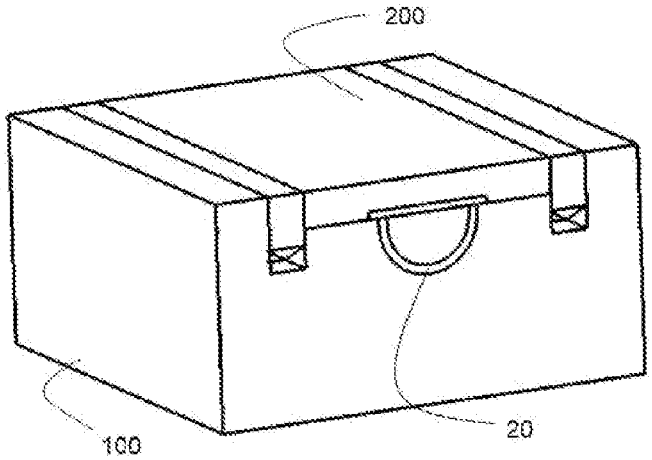
FIG. 18 shows a perspective view of the building block with the insulating material in accordance with the present invention.

Referring to FIGS. 17*a* and 17*b*, an insulating material 20 arranged in the channel 10 of the body 100. The insulating material 20 prevents flow of electricity in to the wall of the building, thereby preventing human contact with the electricity. The lid 200 is used for covering the insulated material 20 configured in the body 100 & lid 200 (refer to FIG. 18).

Figure 19A:
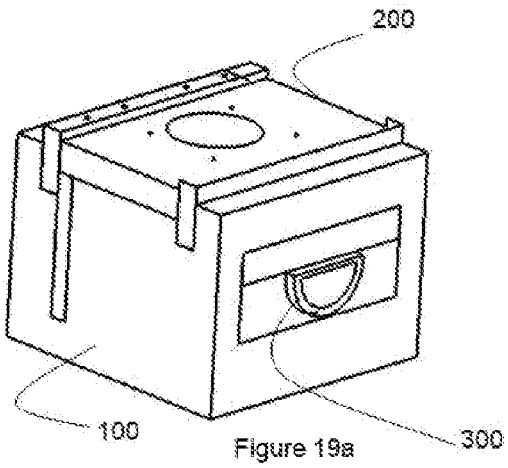
FIG. 19*a* shows a perspective view of a building block with an elbow in accordance with the present invention.
Figure 19B:
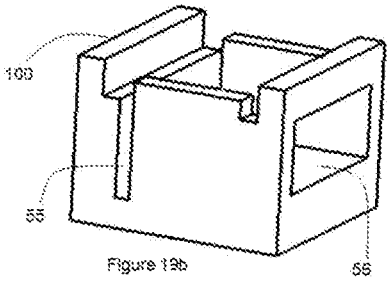
FIG. 19*b* shows a body of FIG. 19*a;*
Figure 19C:
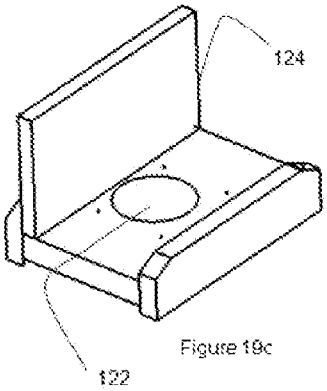
FIG. 19*c* shows a perspective view of an embodiment of the lid with a cap and an opening in accordance with the present invention.

Referring to FIGS. 19*a*, 19*b* and 19*c*, the lid 100 is having an extension 124, with an opening 122. The opening 122 can be accessed for draining purpose or for other maintenance activity. The extension 124 engages with a groove 55 configured on the body 100. An elbow with a cover 250 is arranged in an elbow opening 56 before placing the lid 200 thereover. The lid 200 can be separated to removing the elbow for maintenance.

Figure 20A:
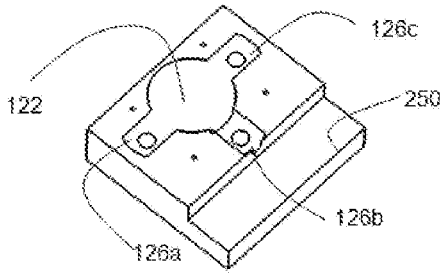
FIG. 20*a* shows a perspective view of an elbow fitting in accordance with the present invention.
Figure 20B:
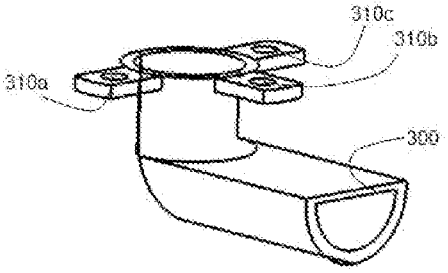
FIG. 20*b* a perspective view of the elbow in accordance with the present invention.
Figure 20C:
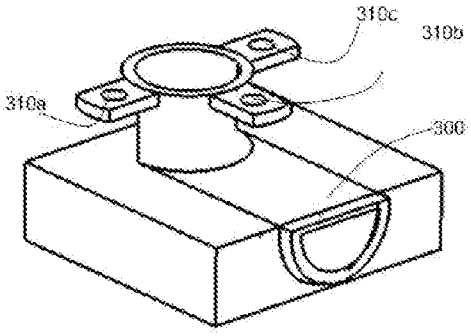
FIG. 20*c* perspective view of an assembly of elbow and the body in accordance with the present invention.

Referring to FIG. 20*a*, the lid 200 is having an opening 122 and apertures 126*a*, 126*b* and 126*c*. An elbow joint 300 is having extension 310*a*, 310*b* and 310*c* (refer FIG. 20*b*), which are placed inside the apertures 126*a*, 126*b* and 126*c* respectively and the elbow 300 is placed in the channel 10 for connecting therewith (refer to FIG. 20*c*).

Figure 21:
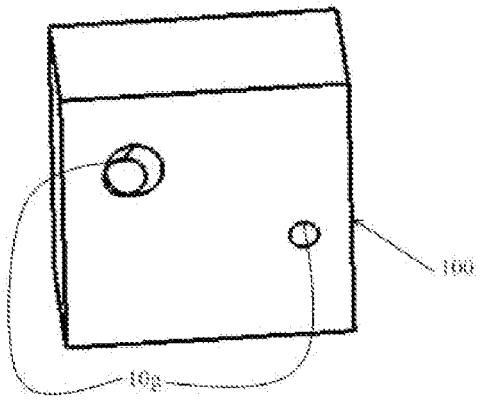
FIG. 21 shows a perspective of an embodiment of body with two round hole for air conditioner, chimney in accordance with the present invention.

FIG. 21 shows an embodiment of the body 100 In one embodiment, the channel 10 is an opening. The body 100 is having through openings 10*g* may be slanting towards the outer side of the building. This openings 10*g* are provided for passing air conditioning ducts therethrough outside the building.

Figure 22:
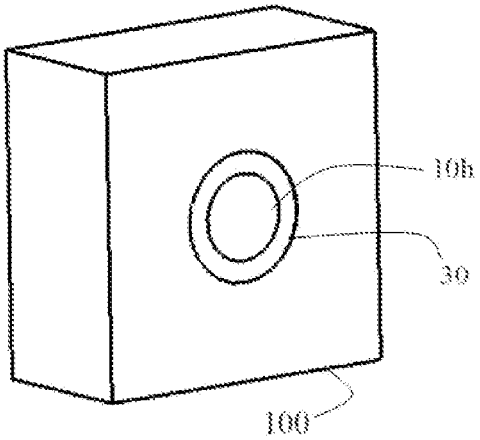
FIG. 22 shows a perspective view of an embodiment of body with a round hole at centre in accordance with the present invention.
Figure 23:
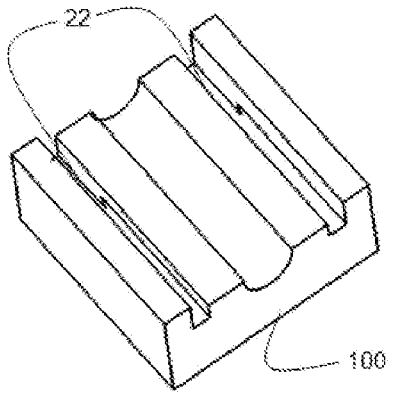
FIG. 23 shows a perspective view of a body with tapered portions in accordance with the present invention.
Figure 24A:
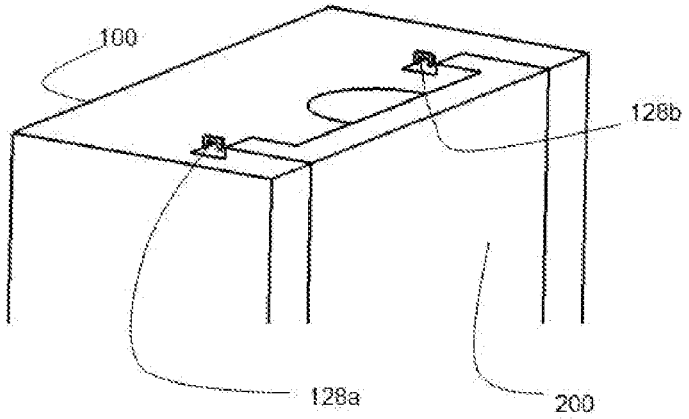
FIGS. 24*a* and 24*b* shows perspective views of a building block with a tapered portions and tapered projections in accordance with the present invention.
Figure 24B:
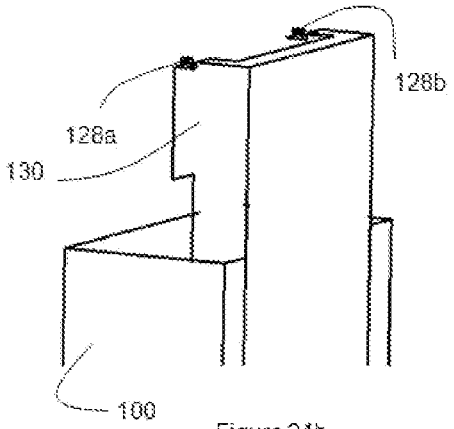

FIG. 22 shows an embodiment of the body 100. In this embodiment, the body 100 has an opening which is reinforced. Referring to FIG. 23, the body 100 is having a tapered portions 22 configured in the cavities 12*a* and 12*b* of the body 100. The assembly of the body 100 and the lid 200 is shown in FIG. 24*a*. The lid 200 is having tapered protrusion 130 for engaging with the tapered portions 22 of the body. Additionally, the lid 200 is having two hooks 128*a* and 128*b*, which is used for unlocking the lid 200 from the body 100 as shown in FIG. 24*b*.

Figure 25:
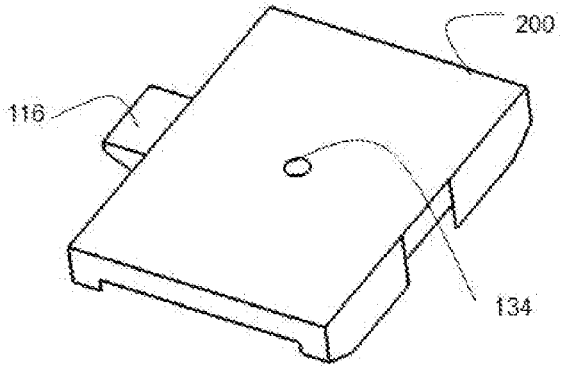
FIG. 25 shows a perspective view of an embodiment of the lid with extensions and opening in accordance with the present invention.
Figure 26:
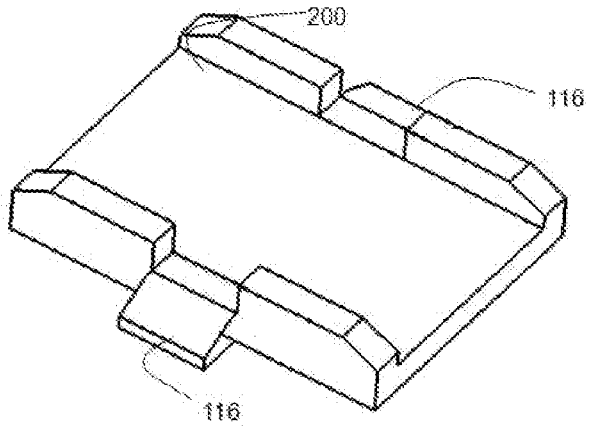
FIG. 26 shows a perspective view of a lid with two extensions in accordance with the present invention.

Referring to FIG. 25, the lid 200 is having a locator 134 for locating the passage of the wiring or piping formed the channels 10 of the building block 100 for inserting tools for disengaging the lid 200 from body 100 without affecting the wall. Also, the lid 200 has at least one extension 116 for covering the channels like L-shaped, T-shaped etc. The lid has two extensions 116 which is away from the lid 200 as shown in FIG. 26.

Figure 27:
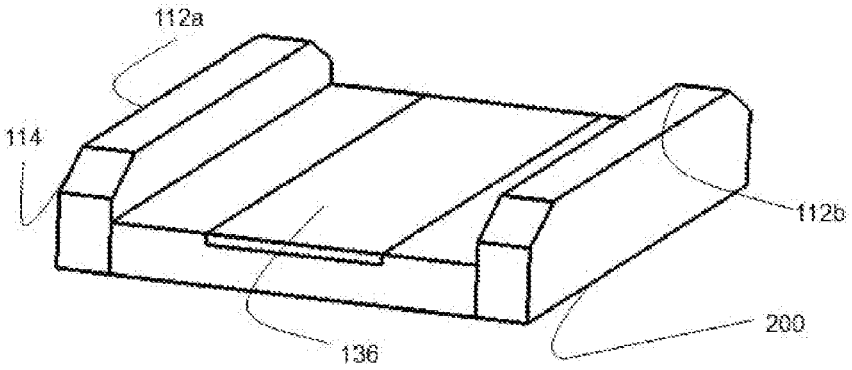
FIG. 27 shows a perspective view of the lid with a drill resistant material in accordance with the present invention.

Referring to FIG. 27, the lid 200 having the projections 112*a* and 112*b* and the at least one tapered corner 114 is shown. The lid 200 is having a plate 136 arranged on the surface for preventing drilling therethrough. The drill resistant plate 136 prevents human contact with the electricity. The plate 136 is about 5 mm in width inserted in the lid 200 at inner face. Drilling for mounting like screw for watch mounting, water filter etc. is not possible beyond certain depth on the lid 200. The plate 136 avoids tearing of wires due to drilling in the wall. The plate 136 also prevents contact of electrical current in wall through lid 200.

Figure 28:
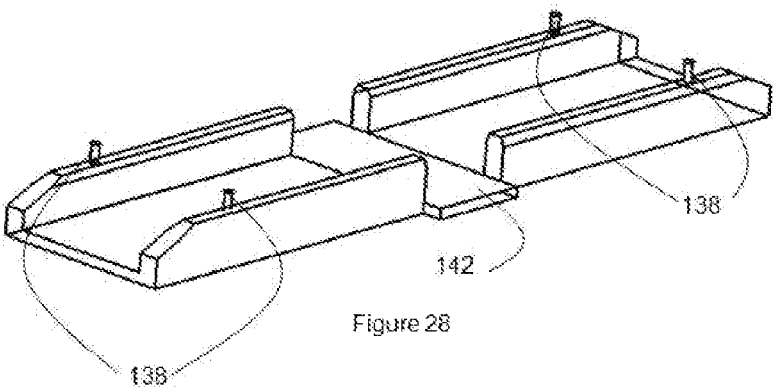
FIG. 28 shows a perspective view an embodiment of the lid in accordance with the present invention.

FIG. 28 shows an embodiment of the lid 200. The lid 200 is shown to include a plurality of locking protrusions 138 for engaging with a respective plurality of cavities (not shown) configured on the cavities 12*a* and 12*b* of the lid 200. The lid 200 is having cross-opening 142 at middle for passing of cross pipes in the lid.

The one or more building blocks and lids of the present invention shown FIGS. 1-28 when arranged in a predefined way forms a wall or pathways having a passage of required size, shape and depth for inserting cables and/or pipelines at the time of the building a wall or pathways as per user needs or drawings given by the architecture for building said wall/pathway and no further work like cutting/drilling is required to make the passageways for concealing cables or pipes.

Therefore, the present invention provides a building block for constructing a passage in a building for passing water pipe line, electric cables, gas pipelines, internet cable, set top box cables, and the like. The building block reduces the time in cutting and drilling in the wall for maintenance purpose. Also, the building block does not damage the wall for maintenance of water pipe line, electric cables, gas pipelines, internet cable, set top box cables, and the like. Further, the building block reduces the destruction of the old building, thereby protecting the environment from debris and dust. Furthermore, the building block 1000 is simple and economical in operation. Moreover, the building block 1000 is robust in operation.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention:

I claim:

1. A building block for constructing a passage in a building for passing cables and/or pipes, the building block comprising:

a body, the body having at least one channel extending across a front surface of the body and cavities formed within the front surface of the body extending lengthwise along the at least one channel and parallel to the at least one channel on the front surface, said at least one channel forms an inbuilt passage integral with the body for circulating or refitting the cables and/or pipes in a horizontal and/or a vertical direction or at a predefined angle non-fixed within said at least one channel and passing through said at least one channel, when the building block is positioned with a plurality of building blocks aligned continuously in a predefined sequence in a wall, roof and/or floor of the building; and a lid with a locator on an outer face of the lid for locating the inbuilt passage and a plate located within an inner face of the lid, aligned over the body, said lid having projections extending lengthwise toward and away from the body, said projections extending towards the body receivable in the cavities of the body for closing and opening the at least one channel, said cavities additionally have at least a base surface with a recessed tapered corner being recessed from said base surface into the body for receiving a plurality of raised corner protrusions having a plurality of hooks of the lid or said at least base surface has a plurality of holes formed within said base surface for receiving a plurality of locking protrusions of the lid, each of said raised corner protrusions with said plurality of hooks or each of said plurality of locking protrusions, extend further away from the projections of the lid that extends towards the body for additionally locking the lid and the body, creating a gap for engaging and disengaging the lid from the body, and said lid has at least one extension extending away from the lid that removably covers the at least one channel and secures against the body.

2. The building block as claimed in claim 1, wherein the at least one channel is one of straight shaped, "O" shaped, "T" shaped, "L" shaped, and "+" shaped.

3. The building block as claimed in claim 1, wherein the at least one channel comprises a plurality of channels that are parallel or non-parallel to each other.

4. The building block as claimed in claim 1, wherein an inner surface of the at least one channel in the body and a channel covering surface of the lid comprises a coating of an insulating material.

5. The building block as claimed in claim 1, wherein the at least one channel has a rectangular or a circular configuration, said rectangular or circular configuration being adaptable to receive a junction box therein.

6. The building block as claimed in claim 1, wherein the at least one channel comprises a through-opening for entry or exit of the pipe and/or cable.

7. The building block as claimed in claim 1, further comprising an insert secured over the at least one channel and below the lid.

8. The building block as claimed in claim 1, wherein the body has a connecting projection and a groove configured on an opposite surface of the body for aligning with an adjacent building block.

9. The building block as claimed in claim 1, wherein the projections of the lid have a cross-opening at a middle of the lid for passing of cross pipes in the lid.

10. The building block as claimed in claim 1, wherein the projections extending away from the body are used for securing a tile or a decorative display therein.

11. The building block as claimed in claim 1, wherein the lid locks against the body by a press-fit of snap-fit locking arrangement or by bolts.

12. The building block as claimed in claim 1, wherein the lid has at least one extension that covers the at least one channel of the building block.

13. The building block as claimed in claim 1, wherein the body and/or the lid is made of materials selected from the group consisting of cement, plastic, clay, gypsum, and FRP.

14. A building block for constructing a passage in a building for pipes including a water pipeline, and a sewage pipeline, the building block comprising:

a lid with an extension and an opening; and a body having a groove and an elbow opening integral with the body, wherein the extension of the lid engages with the groove configured on the body and secures against the body, an elbow having an elbow cover aligned at a top surface of the elbow and an elbow channel aligned at a bottom surface of the elbow, said elbow with the elbow cover and the elbow channel being aligned within the elbow opening of the body before placing the lid thereover.

* * * * *